US006618994B1

(12) United States Patent
Nussbaum

(10) Patent No.: US 6,618,994 B1
(45) Date of Patent: Sep. 16, 2003

(54) SLIDING-ROTATING LEAF SYSTEM WHICH CAN BE LOCKED

(75) Inventor: Bjoern Nussbaum, Osnabrueck (DE)

(73) Assignee: Solarlux Aluminium Systeme GmbH, Bissendorf (DE)

( * ) Notice: Subject to any disclaimer, the term of this patent is extended or adjusted under 35 U.S.C. 154(b) by 108 days.

(21) Appl. No.: 09/664,929

(22) Filed: Sep. 19, 2000

(30) Foreign Application Priority Data

Sep. 20, 1999 (DE) ..... 199 45 035
Jan. 20, 2000 (DE) ..... 100 02 074

(51) Int. Cl.[7] ..... E05D 15/22
(52) U.S. Cl. ..... 49/180; 49/177; 292/171
(58) Field of Search ..... 49/449, 450, 177, 49/178, 180, 183, 184, 185, 176; 292/38, 141, 171

(56) References Cited

U.S. PATENT DOCUMENTS 1,473,982 A * 11/1923 Watson ..... 49/450
1,552,690 A * 9/1925 Frantz ..... 49/449
3,129,470 A * 4/1964 Schneider ..... 49/450
5,169,205 A * 12/1992 James ..... 296/146
5,398,447 A * 3/1995 Morse ..... 49/185
5,486,026 A * 1/1996 Borgardt ..... 292/71
5,657,578 A * 8/1997 Thompson ..... 49/141
6,276,092 B1 * 8/2001 Neo ..... 49/183
6,279,266 B1 * 8/2001 Searcy ..... 49/183

FOREIGN PATENT DOCUMENTS

DE 3900412 7/1990
DE 29718854 2/1998

* cited by examiner

*Primary Examiner*—Jerry Redman
(74) *Attorney, Agent, or Firm*—Jordan and Hamburg LLP

(57) ABSTRACT

A rotating and/or sliding leaf system, which can be locked, with a leaf (1), which can be swiveled and/or shifted and can be fixed in a system frame by two locking bars (5), which can be shifted and are mounted opposite to one another, wherein the locking bars (5) are connected by an actuating element in such a manner that, upon pulling on the actuating element in the opening direction (7) of the leaf (1), both locking bars (5) are moved simultaneously from a locking position into a position, in which the leaf (1) is unlocked from the leaf frame and released so that it can be swiveled or shifted. The actuating element is formed flexibly from a rope (6).

31 Claims, 3 Drawing Sheets

SLIDING-ROTATING LEAF SYSTEM WHICH CAN BE LOCKED

BACKGROUND OF THE INVENTION

The invention relates to a rotating leaf system and/or a sliding rotating leaf system which can be locked. Such systems, especially sliding rotating leaf systems, such as systems for enclosing a balcony with glass, for dividing a room, for providing shade, etc., require a lock which secures the system against an unintended opening or swiveling of a leaf. The lock locks the leaf to the system frame.

For this purpose, in the case of systems which are used in practice, two mutually opposite disposed locking bars are provided which, in the case of rotating leaves, can be swiveled about a vertical axis of rotation. The locking bars are placed at an upper and a lower edge laterally on the rotating leaf and engage lugs or clasps, placed on a system frame and assigned to the locking bars or, correspondingly, fittings having an opening for the locking bars. For each locking bar there is an actuating handle. To open the leaf system, both handles must be actuated simultaneously and, at the same time, the leaves caused to swivel or slide. This requires both hands of the person operating the system and it is frequently regarded as a deficiency that actually a third hand would be required to initiate the swiveling or sliding motion of the leaf. In addition, smaller persons consider it very inconvenient to operate large leaves, since the span of the arms in some cases is hardly sufficient for reaching both handles of the locking bars simultaneously.

SUMMARY OF THE INVENTION

It is therefore an object of the invention to provide a leaf system, which can be locked and is more convenient to operate and, in particular, is more convenient to open.

The present invention provides a connection of two locking bars by a common actuating element which, when a tensile force is exerted in the direction in which a leaf is opened, retracts the locking bars into a position releasing the leaf, and enables the leaf system to be opened with one hand which, by means of the actuating element, unlocks and, at the same time, initiates the swiveling or sliding motion of the leaf.

Preferably, the actuating element is developed flexibly, so that an actuation by tension at any convenient region of the actuating element is possible without having to provide a particular handle height or the like. With that, persons of different size can take hold of the actuating element at a height and position convenient for them. A flexible actuating element can be realized most easily and inexpensively by a rope which, because of its stability and the absence largely of wear, can be a steel rope.

Further advantages and details arise out of the dependent claims and from an example of the invention, which is described below and shown in the accompanying drawings.

DESCRIPTION OF THE PREFERRED EMBODIMENTS

The rotating leaf system, shown in FIGS. 1 to 4, includes a rotating leaf 1, which can be swivelled about an axis of rotation that is not shown and which is mounted in a system frame. The embodiment shown is a sliding-rotating leaf system, which, in addition to the rotating leaf 1 shown, has further sliding rotating leaves, which are not shown and are disposed to the left of the rotating leaf 1. For the movable mounting of the sliding-rotating leaf, the system frame therefore is constructed as a rail 2, which extends above and below the rotating leaf 1 and the sliding rotating leaves.

Figure 1:
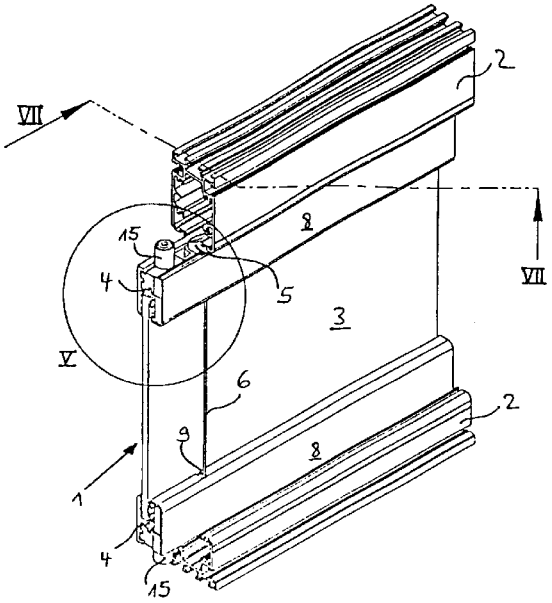
FIG. 1 shows a perspective representation of an inventive rotating leaf system with the locking bar disposed in the locking position.
Figure 2:
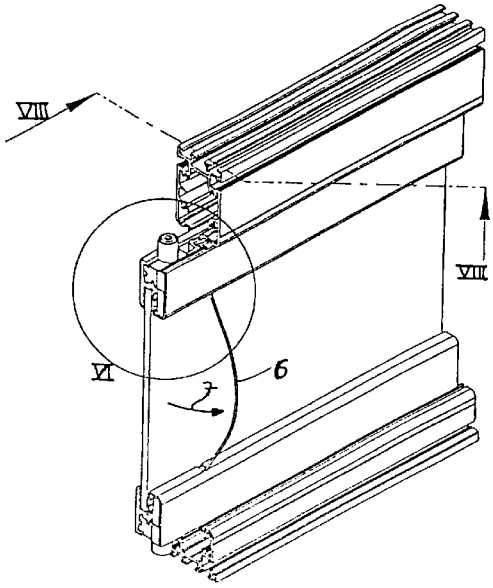
FIG. 2 shows the object of FIG. 1 in the unlocked position.
Figure 3:
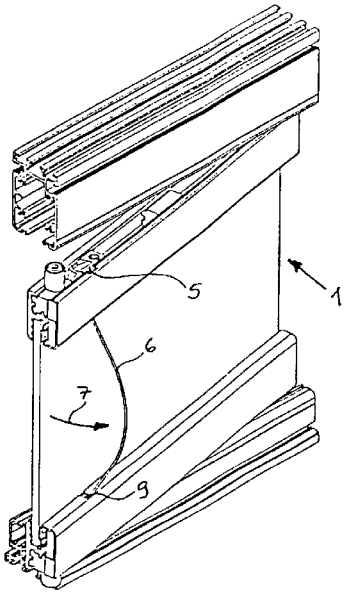
FIG. 3 shows the object of FIG. 2 with the rotating leaf swiveled slightly open.
Figure 4:
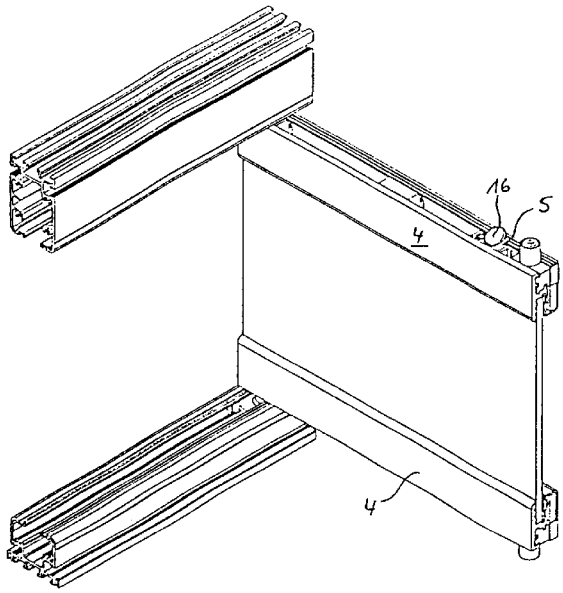
FIG. 4 shows the object of FIG. 1 with the rotating leaf swiveled open completely.

In the case of the embodiment shown, the rotating leaf 1 has an area element 3, which is held at its upper side and underside in a frame 4. In the frame 4, there are two locking bars 5, which are connected by an actuating rope 6, which is stretched between them vertically along the area element 3. If the actuating rope 6 is pulled away from the area element 3 in the direction of the arrow 7 (FIGS. 2 and 3), the locking bars 5 move towards the area element 3 and release the rotating wing 1 so that it can move open and swivel. In addition, since the actuating rope 6 and the locking bars 5 are part of the rotating leaf 1 in the case of the embodiment shown, a swiveling-open motion of the rotating leaf 1, as shown in FIG. 3, is initiated with this at the same time.

In the case of previously known systems, the locking bars usually are placed at the side of the frame. In contrast to this, in the case of the preferred embodiment of the invention, the locking bars 5 are disposed in an extension of the area element 3 above and below and guided movably in the frame 4, as shown especially in FIGS. 5 to 8. This arrangement of the locking bars 5 offers the locking bars 5 good protection against the effects of the weather, contamination, etc. and is also visually very appealing, since the locking bars 5 are not visible when the rotating wing system is closed. In the case of sliding-rotating leaf systems like those shown, the rail 2, which is open at one side, can at the same time serve as a recess, which is engaged by the locking bars 5 in the locking position, so that no further visually disturbing elements, such as lugs, hooks or clasps have to be mounted on an outside of the system frame.

The upper and lower frames 4 preferably have at least on one side a covering section 8 which, to simplify the installation of the parts on the inside, can be put or locked in place only as a final step. Each of the covering sections 8 has an opening 9, through which the actuating rope 6 extends. The arrangement of the locking bars 5, so covered, provides the rotating leaf system furthermore with a pleasing appearance, since only the actuating element of the whole of the locking arrangement is visible. The actuating rope 6 is preferably a filigreed steel or plastic rope so it recedes visually almost completely and does not interfere with the transparent impression, especially in the case of systems with the area element 3 formed of glass.

Figure 5:
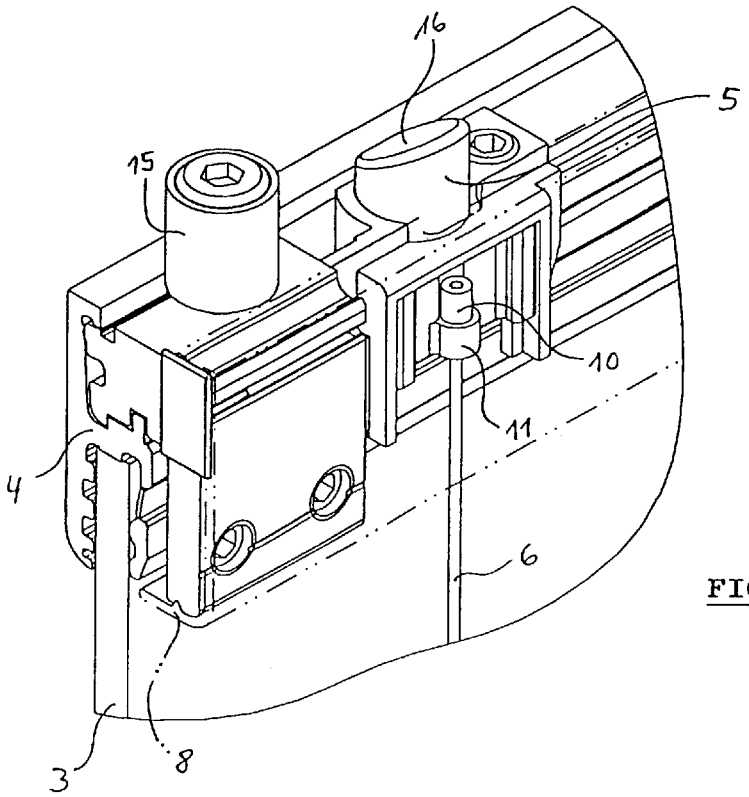
FIG. 5 shows an enlargement of the cutout V of FIG. 1.
Figure 6:
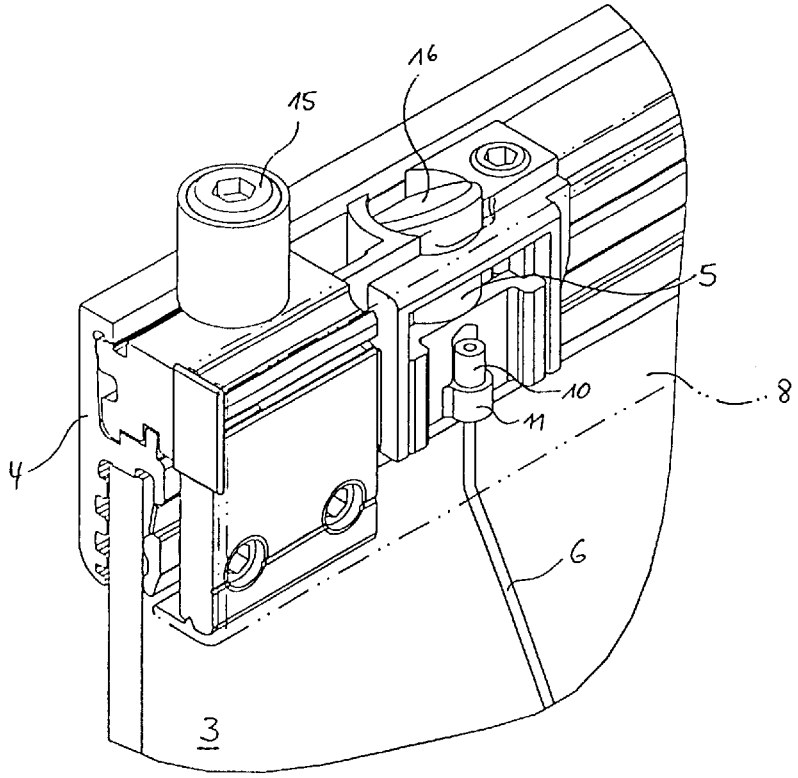
FIG. 6 shows an enlargement of the cutout VI of FIG. 2.

For FIGS. 5 and 6, the covering section 8 is indicated only by lines of dots and dashes to indicate that it is transparent, so that the height adjustability of the locking bars 5 in the frame 4 can be recognized. The actuating rope 6 is suspended with a terminal thickening 10 in an appropriate lug 11 at the foot of the locking bar 5. This makes it easy to install the locking bar arrangement even on site when installing the rotating leaf system.

Figure 7:
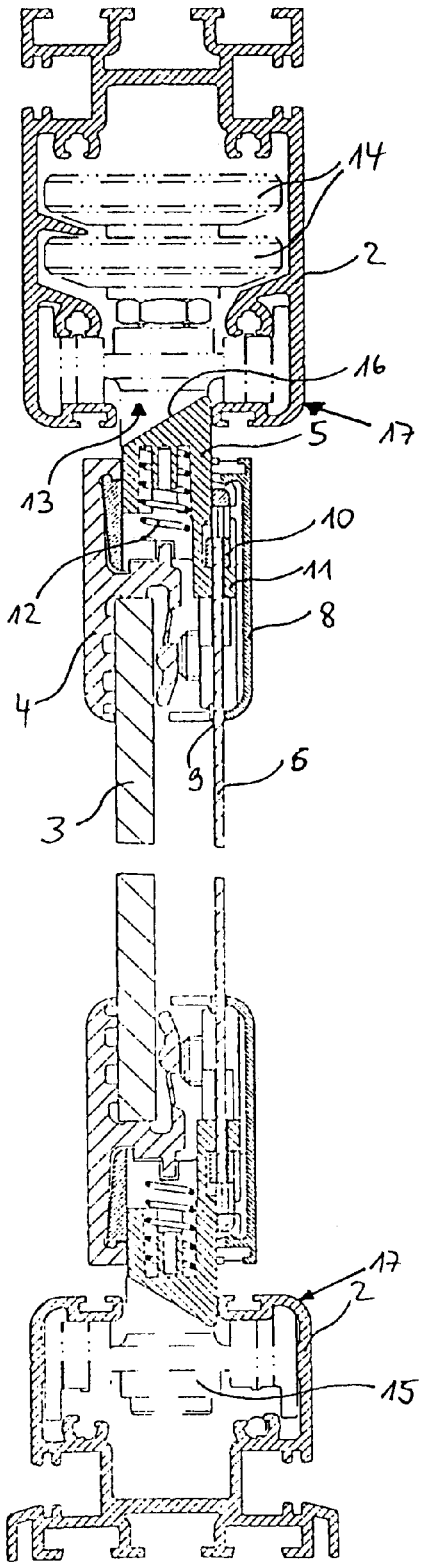
FIG. 7 shows a section in the direction VII—VII through the object of FIG. 1.
Figure 8:
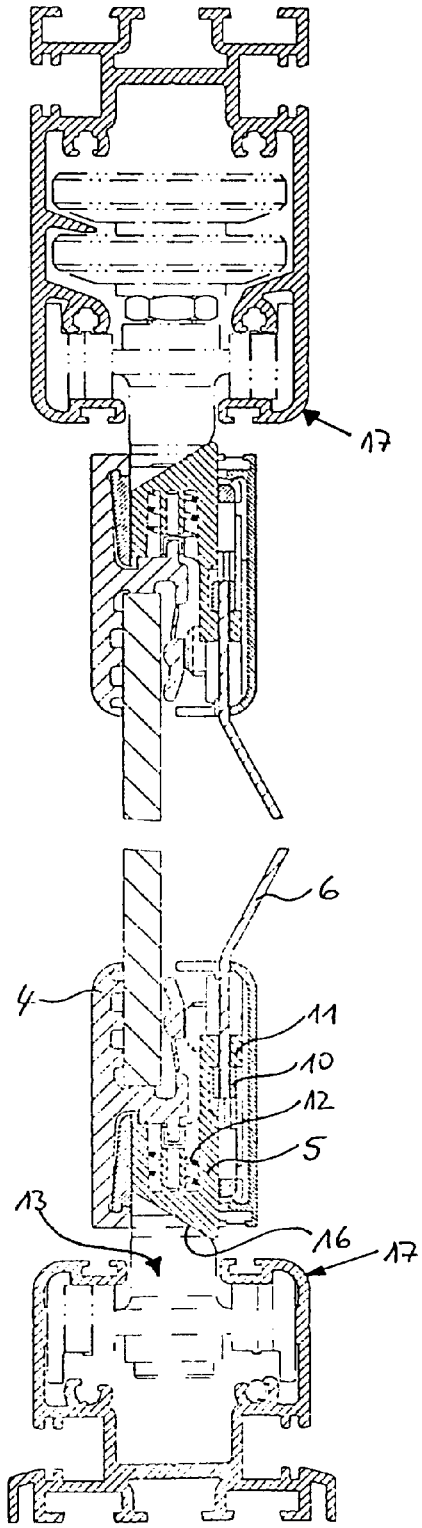
FIG. 8 shows a section in the direction VIII—VIII through the object of FIG. 2.

FIGS. 7 and 8 show in detail the arrangement of the locking bars 5 and their interlocking with the rails 2. In the case of a flexible actuating element such as the actuating rope 6, which can pass on only tensile forces but not compressive forces, it is necessary to bring the locking bars 5 back into the locking position for the locking procedure. For this purpose, each locking bar 5 has a compression spring 12, which pushes the locking bar 5 out of the frame 4 when the tension is relieved on the actuating rope 5. In the locking position, the locking bar 5 therefore protrudes above the frame 4 to such an extent, that it can engage the opening 13 of the rail 2. FIGS. 7 and 8 additionally show, by lines of dots and dashes, the guidance of the rotating leaf 1 in the rails 2 by guiding rolls 14 and guiding pins 15 forming the axis of rotation.

So that the actuating rope 6 does not have to be pulled once again when the rotating leaf 1 is closed, the locking bars 5, at their ends protruding from the frame 4, are provided in each case with a sliding slope 16, which automatically forces the locking bar 5 back into the frame 4 when, as the rotating leaf 1 is closed. Pressure is exerted on the sliding slope 16 by an edge 17 of the rail 2 to force the locking bar 5 back into the frame.

Preferably, for stability reasons, the rails 2 and the frame 4 are produced from metallic materials. In order to avoid noise and wear during the metal-to-metal contact movements, the locking bars 5 should then preferably be produced from a plastic or from a different material with similar properties.

Of course, the use of the locking system described is not limited to the special example. For example, strictly sliding leaf systems can also be constructed so that they can be locked pursuant to the invention. Sliding-rotating leaf systems may also, for example, have such a locking system at each sliding-rotating leaf, the locking bar then preferably being disposed at the side of the sliding-rotating leaf, which cannot be swivelled out, and functioning at the same time as the axis of rotation, in that, in the locked position, they merely prevent a shifting of the sliding-rotating leaf, but permit it to swivel. Finally, it should still be emphasized that the system frame of the inventive system need not necessarily be a separate part. It may also be an integral component of the building, carrying the system, and be formed, for example, by the masonry.

To summarize, the leaf system is distinguished by a particularly simple operation, a pleasing appearance and by little wear. The fittings used require little maintenance, are resistant to the weather, are functionally reliable and do not rattle.

What is claimed is:

1. A leaf system adapted to be moveable relative to an associated structure, the leaf system comprising:

a least one area element movably supported on said associated structure to move between an open position and a closed position, said area element being substantially planar and thereby defining an area element plane;

a pair of locking devices on said area element;

each of said locking devices including a support unit and a locking element mounted on said support unit for movement between a locking and a non-locking position, said pair of locking devices being adapted to establish a locking relationship with said associated structure when said locking elements are in said locking position and said area element is in said closed position, and to establish a non-locking relationship with said associated structure when said locking elements are in said non-locking position permitting displacement of said area element to said open position in an opening direction directed out of said area element plane; and an actuator element interconnecting said locking elements and disposed to be manually pulled in a pulling direction directed out of said area element plane to move said locking elements from said locking to said unlocking position to thereby establish said non-locking relationship between said locking elements and said associated structure and to then move said area element toward said open position by continued pulling in said pulling direction.

2. The leaf system according to claim 1 wherein said actuator element extends in a generally linear direction when said locking elements are in said locking position, said pulling direction being directed generally transverse to said linear direction to effect movement of said locking elements from said locking position to said non-locking position.

3. The leaf system according to claim 2 wherein said actuator element extends in a non-linear disposition when said actuator element is manually pulled in said pulling direction to effect said movement of said locking elements from said locking to said non-locking position.

4. The leaf system according to claim 1 wherein said actuator element is linearly disposed when said locking elements are in said locking position, said actuator element having a linear length when linearly disposed, said locking devices further comprising connectors connecting said actuator element to said locking elements, said connectors being spaced from one another a distance substantially equal to said linear length of said actuator.

5. The leaf system according to claim 1 wherein the actuator element is flexible.

6. The leaf system according to claim 1 wherein the actuator element is a rope.

7. The leaf system according to claim 1 wherein each locking device includes a biasing unit biasing each locking element toward said locking position.

8. The leaf system according to claim 1 wherein said area element is adapted to be moved from said closed position relative to said associated structure and to said open position relative to said associated structure, each of said locking elements being displaced along linear axes when being moved between said locking and non-locking positions, each of said locking devices including a biasing unit biasing said locking element in a first linear direction toward the locking position, said locking element being in said locking position when said area element is in said closed position.

9. The leaf system according to claim 8 wherein each of said locking elements has a sloping end surface disposed at an acute angle relative to the respective linear axis, said sloping surface engaging said associated structure as said area element is moved toward said closed position to effect displacement of said locking element in a second linear direction opposite said first linear direction.

10. The leaf system according to claim 1 wherein each of said locking elements is disposed substantially within said support unit when said locking element is in said non-locking position, each of said locking elements protruding from said support unit when said locking element is in said locking position.

11. The leaf system according to claim 1 wherein the area element comprises at least one leaf unit and at least one frame mounted on said leaf unit, said area element further comprising mounting parts mounting said locking devices on said frame.

12. The leaf system according to claim 1 wherein said actuator element is disposed on one side of the area element.

13. The leaf system according to claim 1 wherein the actuator element is an elongated flexible element.

14. A leaf system comprising:

an associated structure;

a least one area element, said area element being substantially planar thereby defining an area element plane;

mounting parts movably mounting said area element on said associated structure to move between a closed position to an open position displaced partially from said associated structure;

a pair of locking devices on said area element, each of said locking devices including a support unit and a locking element mounted on said support unit for movement between a locking and a non-locking position, said pair of locking devices being adapted to establish a locking relationship with said associated structure when said locking elements are in said locking position and said area element is in said closed position, and to establish a non-locking relationship with said associated structure when said locking elements are in said non-locking position permitting displacement of said area element to said open position in an opening direction directed out of said area element plane; and an actuator element interconnecting said pair of locking elements and disposed to be manually pulled in a pulling direction out of said area element plane to move said pair of locking element from said locking to said unlocking position to thereby establish said non-locking relationship between said locking elements and said associated structure and to then move said area element toward said open position by continued pulling in said pulling direction.

15. A leaf system associated to claim 14 wherein said mounting parts rotatably mount said area element on said associated structure.

16. A leaf system associated to claim 14 wherein said mounting parts slidably mount said area element on said associated structure.

17. A leaf system according to claim 14 wherein said actuator element extends in a generally linear direction when said locking elements are in said locking position, said actuator element is manually pullable in said pulling direction which is directed generally transverse to said linear direction to effect movement of said locking elements from said locking position to said non-locking position, said actuator element extending in a non-linear disposition when said actuator element is manually pulled generally transversely of said linear direction to effect said movement of said locking elements from said locking to said non-locking position.

18. A leaf system according to claim 14 wherein each locking device includes a biasing unit biasing each of said locking elements toward said locking position, said actuator element being linearly disposed when said locking elements are biased in said locking position by said biasing unit, said actuator element having a linear length when linearly disposed, said locking devices further comprising connectors connecting said actuator element to said locking elements, said connectors being spaced from one another a distance substantially equal to said linear length of said actuator.

19. A moving panel apparatus comprising:

a panel having a major surface defining a panel plane;

a top frame member and a bottom frame member;

mounts for pivotally mounting said panel between said top frame member and said bottom frame member such that said panel pivots in a plane orthogonal to said panel plane;

a top lock mechanism mounted on a top portion of said panel and having an engagement member displaeable between a locked position for engaging said top frame to prevent pivoting of said panel and an unlocked position for disengaging said top frame to permit pivoting of said panel, and a bias device biasing said engagement member toward said locked position;

a bottom lock mechanism mounted on a bottom portion of said panel and having an engagement member displaceable between a locked position for engaging said bottom frame to prevent pivoting of said panel, and an unlocked position for disengaging said bottom frame to permit pivoting of said panel, and a bias device biasing said engagement member toward said locked position;

a flexible linear actuator having a top end connected to said engagement member of said top lock mechanism, and a bottom end connected to said engagement member of said bottom lock mechanism, said engagement members being displaceable such that force applied to said flexible linear actuator in a direction substantially perpendicular to said panel plane is applied at least partially to said engagement members by said flexible linear actuator so as to displace said engagement members, against bias of said biasing devices, from said locked positions to said unlocked positions and such that said force applied to said flexible linear actuator further acts to pivot said panel with respect to said top and bottom frame members.

20. The moving panel apparatus of claim 19 further comprising top and bottom guides for said flexible linear actuator which deflect said flexible linear actuator when said force is applied so as to redirect at least a portion of said force to directions substantially parallel to said panel plane to displace said engagement members of said top and bottom lock mechanisms to said unlocked position.

21. The moving panel apparatus of claim 20 wherein said flexible linear actuator is a line.

22. The moving panel apparatus of claim 21 wherein said engagement members are displaceable in a plane parallel said panel plane.

23. The moving panel apparatus of claim 21 wherein said engagement members are displaceable in a vertical direction and said top and bottom guides direct force deflect said flexible linear actuator to direct at least a portion of force thereof into the vertical direction.

24. The moving panel apparatus of claim 19 wherein said flexible linear actuator is a line.

25. The moving panel apparatus of claim 24 wherein said engagement members are displaceable in a plane parallel said panel plane.

26. The moving panel apparatus of claim 24 wherein said engagement members are displaceable in a vertical direction and at least a portion of said force applied to said flexible linear actuator is directed into the vertical direction.

27. The moving panel apparatus of claim 19 wherein said engagement members are displaceable in a plane parallel said panel plane.

28. The moving panel apparatus of claim 19 wherein said engagement members are displaceable in a vertical direction and said flexible linear actuator deflects to direct at least a portion of force thereof into the vertical direction.

29. A moving panel apparatus comprising:

a panel having a major surface defining a panel plane;

a top frame member and a bottom frame member;

mounts for pivotally mounting said panel between said top frame member and said bottom frame member such that said panel pivots in a plane orthogonal to said panel plane;

a top lock mechanism mounted on a top portion of said panel and having an engagement member displaceable in a plane parallel to said panel plane between a locked position for engaging said top frame to prevent pivoting of said panel, and an unlocked position for disengaging said top frame to permit pivoting of said panel, and a bias device biasing said engagement member toward said locked position;

a bottom lock mechanism mounted on a bottom portion of said panel and having an engagement member displaceable in a plane parallel to said panel plane between a locked position for engaging said bottom frame to prevent pivoting of said panel, and an unlocked position for disengaging said bottom frame to permit pivoting of said panel, and a bias device biasing said engagement member toward said locked position;

a flexible line having a top end connected to said engagement member of said top lock mechanism, and a bottom end connected to said engagement member of said bottom lock mechanism, top and bottom guides for said flexible linear actuator which deflect said flexible linear actuator such that when force applied to said flexible linear actuator in a direction substantially perpendicular to said panel plane at least a portion of said force is redirected in directions substantially parallel to said panel plane to displace said engagement members of said top and bottom lock mechanisms to said unlocked positions, against bias of said biasing devices, and such that said force applied to said flexible linear actuator further acts to pivot said panel with respect to said top and bottom frame members.

30. The moving panel apparatus of claim 29 wherein at least one of said top and bottom guides is a cover panel defining an aperture through which said flexible line passes to effect redirection of force.

31. The moving panel apparatus of claim 30 wherein said engagement members are displaceable in a vertical direction and said flexible line is deflected by said top and bottom guides to direct at least a portion of force thereof into the vertical direction.

* * * * *